US010046354B2

(12) United States Patent
Sumiyoshi

(10) Patent No.: US 10,046,354 B2
(45) Date of Patent: Aug. 14, 2018

(54) BLADE DEVICE, AND PRINTER AND COATING APPARATUS PROVIDED WITH SAID BLADE DEVICE

(71) Applicant: Chiba Machine Industry Corporation, Kashiwa-Shi (JP)

(72) Inventor: Koji Sumiyoshi, Kashiwa (JP)

(73) Assignee: Chiba Machine Industry Corporation, Kashiwa-shi (JP)

( * ) Notice: Subject to any disclaimer, the term of this patent is extended or adjusted under 35 U.S.C. 154(b) by 0 days.

(21) Appl. No.: 15/512,375

(22) PCT Filed: Sep. 19, 2014

(86) PCT No.: PCT/JP2014/074954
§ 371 (c)(1),
(2) Date: Mar. 17, 2017

(87) PCT Pub. No.: WO2016/042677
PCT Pub. Date: Mar. 24, 2016

(65) Prior Publication Data

US 2017/0274406 A1 Sep. 28, 2017

(51) Int. Cl.
*B41F 9/10* (2006.01)
*B05C 1/08* (2006.01)
(Continued)

(52) U.S. Cl.
CPC ..... *B05C 1/0834* (2013.01); *B05C 11/1036* (2013.01); *B41F 9/1072* (2013.01); *B41F 31/20* (2013.01); *B05C 11/10* (2013.01)

(58) Field of Classification Search
None
See application file for complete search history.

(56) References Cited

U.S. PATENT DOCUMENTS 2,914,788 A * 12/1959 Smith ..... B41F 9/1045 118/125
3,131,092 A 4/1964 Coghill
(Continued)

FOREIGN PATENT DOCUMENTS

DE 1109187 B 6/1961
GB 2459293 A 10/2009
(Continued)

OTHER PUBLICATIONS

International Search Report for PCT/JP2014/074954 dated Dec. 16, 2014.
(Continued)

*Primary Examiner* — Jill Culler
(74) *Attorney, Agent, or Firm* — Drinker Biddle & Reath LLP

(57) ABSTRACT

Provided are a blade device equipped with a blade member which can accurately adjust pressing force due to a blade member, and a printing machine and a coating device equipped with the blade device. A blade device according to the present invention has: a blade member contacting with a plate roll to which coating material is to be applied; an upper holder contacting with the blade member from one surface side of the blade member; a lower holder contacting with the blade member from another surface side of the blade member; a tube contacting with the blade member and configured to expand and contract by pressure of fluid; and a tube positioning part which is provided on the upper holder and positions the tube closer to the roller, in a direction in which the blade member extends, than a tip end of the lower holder is. The tube adjusts a pressing force, of the tip end of the blade member, against the roller by being expanded or contracted while being held by the tube positioning part and the blade member.

14 Claims, 7 Drawing Sheets

(51) Int. Cl.
*B05C 11/10* (2006.01)
*B41F 31/20* (2006.01)

(56) References Cited

U.S. PATENT DOCUMENTS

| | | | | | |
|---|---|---|---|---|---|
| 3,866,266 | A | * | 2/1975 | Dunlap | B41F 9/1036 100/174 |
| 5,085,144 | A | | 2/1992 | Lindstrom et al. | |
| 6,071,550 | A | * | 6/2000 | Ueberschar | B05C 11/041 118/123 |
| 6,305,282 | B1 | | 10/2001 | Dätwyler | |
| 6,637,330 | B1 | | 10/2003 | Nordby et al. | |
| 2009/0151579 | A1 | | 6/2009 | Sumiyoshi | |

FOREIGN PATENT DOCUMENTS

| | | | |
|---|---|---|---|
| JP | S610064361 | U | 5/1986 |
| JP | H08206901 | A | 8/1996 |
| JP | H10128204 | A | 5/1998 |
| JP | 2000516171 | A | 12/2000 |
| JP | 2003502192 | A | 1/2003 |
| JP | 2007152602 | A | 6/2007 |

OTHER PUBLICATIONS

Supplementary European Search Report for European Application No. EP 14 90 1963, dated May 7, 2018.

* cited by examiner

BLADE DEVICE, AND PRINTER AND COATING APPARATUS PROVIDED WITH SAID BLADE DEVICE

CROSS-REFERENCE TO RELATED APPLICATIONS

This application is a national stage application (under 35 U.S.C. § 371) of PCT/JP2014/074954, filed Sep. 19, 2014, which is incorporated herein by reference in its entirety.

TECHNICAL FIELD

The present invention rerates to a blade device, and a printing machine and a coating device which are equipped with the blade device.

BACKGROUND ART

When paint such as ink is applied to a printing machine or the like, a blade member (also referred to as a doctor blade) like a paddle is generally used so that excessive ink is not applied. The blade member is made of metal in a thin plate-like shape and is held by a member holding the both surfaces of the blade member. The blade member is pressed against a roller around which a base material coated with ink is wrapped (see Patent Document 1).

CITATION LIST

Patent Literature

Patent Literature 1: JP 2007-152602 A

SUMMARY OF INVENTION

Technical Problem

However, because the blade member is a member in a thin plate-like shape and a slight change in pressure can affect print quality, it is difficult to adjust pressing force due to the blade member, and further improvement is therefore desired.

In view of the above, the present invention has been made to solve the above issue, and an object of the present invention is to provide a blade device which is equipped with a blade member and is able to accurately adjust the pressing force due to the blade member, and to provide a printing machine and a coating device which are equipped with the blade device.

Solution to Problem

A blade device according to the present invention which achieves the above object has: a blade member contacting with a roller to which coating material is to be applied; a first holding part contacting with the blade member from one surface side of the blade member; a second holding part contacting with the blade member from another surface side of the blade member; a deformation member contacting with the blade member and enabling to expand and contract by pressure of fluid; and a positioning part which is provided on the first holding part and positions the deformation member closer to the roller, in a direction in which the blade member extends, than a tip end of the second holding part. The deformation member adjusts pressing force at the tip end of the blade member against the roller by being expanded and contracted while being held by the positioning part and the blade member. Further, the present invention is a printing machine or a coating device equipped with the above blade device.

Advantageous Effect of Invention

The blade device, the printing machine, and the coating device according to the present invention are equipped with the positioning part which is provided on the first holding part and positions the deformation member closer to the roller, in the direction in which the blade member extends, than the tip end of the second holding part, wherein the deformation member is configured to adjust the pressing force at the tip end of the blade member against the roller by being expanded or contracted while holding the deformation member by the positioning part and the blade member. With this configuration, the pressing force due to the deformation member can act at the tip end of the blade member, and the pressing force due to the deformation member can thus act as the pressing force without being affected by the other members of the blade member. Therefore, the pressing force due to the blade member can act almost without being affected by the other members holding the blade member, and the pressing force on the roller can be adjusted more accurately.

DESCRIPTION OF EMBODIMENTS

Hereinafter, an embodiment of the present invention will be described with reference to the accompanied drawings. Note that the following description does not limit the technical scope or the meanings of the terms described in the claims. Further, the dimension ratios of the drawings are exaggerated for convenience of description and are not the same ratios as the real ratios in some cases.

First Embodiment

Figure 1:
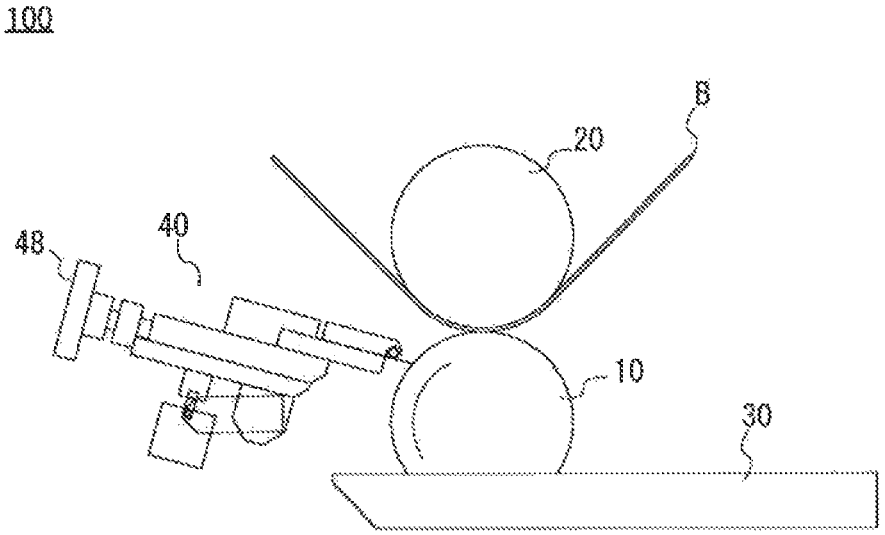
FIG. 1 is a schematic explanatory diagram showing a main part of a printing machine equipped with a blade device according to a first embodiment of the present invention.
Figure 2A:
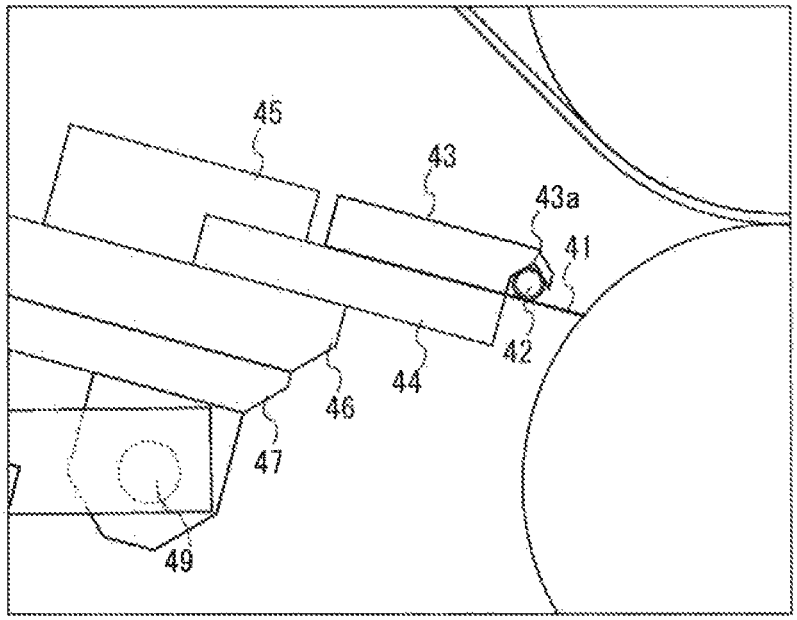
FIG. 2(A) is an enlarged view showing the vicinity of a contact part between a plate roll and a blade in the blade device equipped on the printing machine.
Figure 2B:
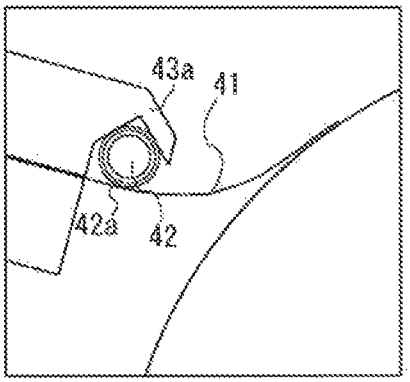
FIG. 2(B) and FIG. 2(C) are further enlarged views of FIG. 2(A) is and show modified examples of the present embodiment.
Figure 2C:
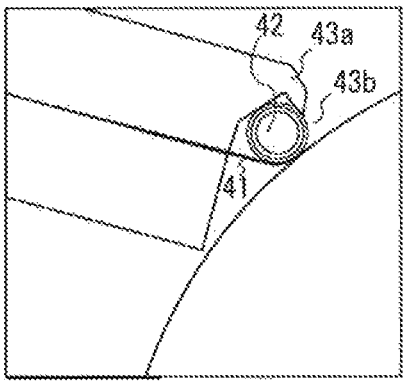
Figure 3A:
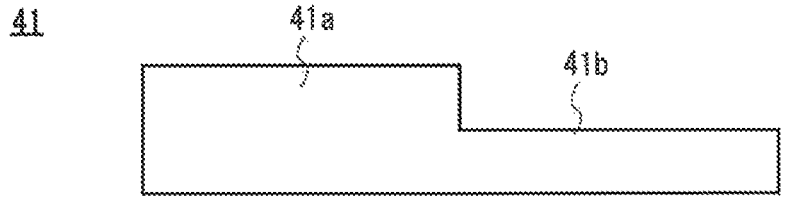
FIG. 3(A) is a partially enlarged view showing a tip end of the blade member in the blade device.
Figure 3B:
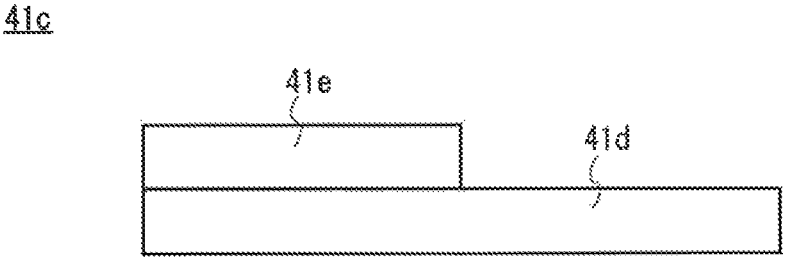
FIG. 3(B) is a partially enlarged view showing a modified example of the blade member.

FIG. 1 is a schematic explanatory diagram showing a main part of a printing machine equipped with a blade device according to a first embodiment of the present invention. FIG. 2(A) is an enlarged view showing the vicinity of a connection part between a plate roll and a blade in a blade device equipped on the printing machine, and FIG. 2(B) and FIG. 2(C) are further enlarged views of FIG. 2(A) and diagrams showing modified examples of the present embodiment. FIG. 3(A) is a partially enlarged view showing a tip end of a blade member in the blade device, and FIG. 3(B) is a partially enlarged view showing a modified example of FIG. 3(A).

Figure 4A:
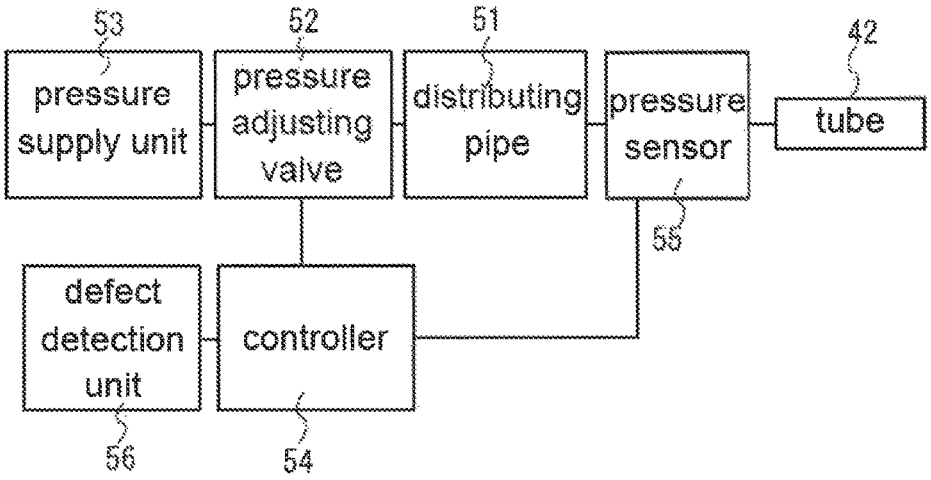
FIG. 4(A) is a block diagram illustrating a configuration for supplying pressure to a tube in the blade device.
Figure 4B:
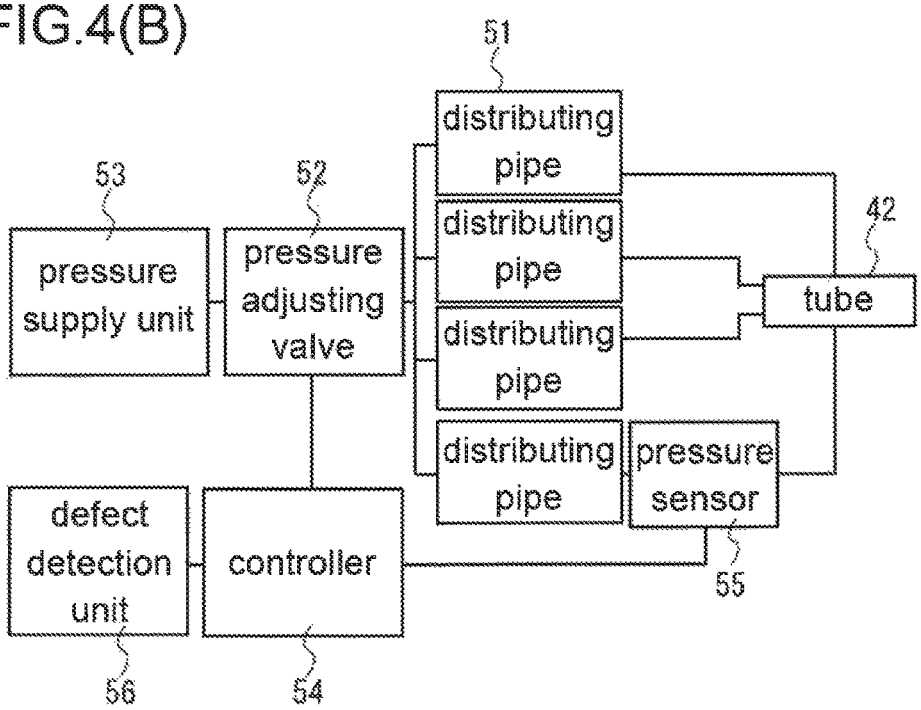
FIG. 4(B) is a block diagram showing a modified example of FIG. 4(A).

FIG. 4(A) is a block diagram illustrating a configuration for supplying pressure to a tube in the blade device, and FIG. 4(B) is a block diagram showing a modified example of FIG. 4(A).

A printing machine 100 equipped with the blade device according to the present embodiment has a plate roll 10, a press roll 20, an ink pan 30, and a blade device 40 as shown in FIG. 1.

In the present embodiment, the plate roll 10 is configured with an intaglio plate roll. The printing machine 100 according to the present embodiment can be used as a so-called gravure printing machine using an intaglio plate. The press roll 20 is configured to be disposed to face the plate roll 10 having a base material B between the press roll 20 and the plate roll 10, and is configured to be in contact with the base material 200 in the vicinity of a contact part between the plate roll 10 and the base material B. The ink pan 30 is configured to store printing ink to supply the printing ink, for example, aqueous printing ink to the plate roll 10. A part (lower part) of the plate roll 10 is soaked in ink poured in the ink pan. Further, an upper part, which is a part of the plate roll 10, is configured to apply pressing force to the base material B together with the press roll 20. With reference to FIG. 1, the plate roll 10 rotates clockwise, and the press roll 20 rotates counterclockwise.

A shown in FIG. 2(A) and FIG. 4, the blade device 40 has a blade member 41, a tube 42 (corresponding to a deformation member), an upper holder 43 (corresponding to a first holding part), a lower holder 44 (corresponding to a second holding part), mounting members 45, 46, and 47, a mounting screw 48, a rotary part 49, a distributing pipe 51, a pressure adjusting valve 52, a pressure supply unit 53, a controller 54, a pressure sensor 55, and a defect detection unit 56.

The blade member 41 is configured with an extremely thin plate member having a thickness of, for example, approximately 0.5 mm and scrapes off excessive paint attached to the plate roll 10. The blade member 41 is also referred to as a doctor blade. In the present embodiment, as shown in FIG. 3(A), the blade member 41 has a contact part 41*a* in contact with the tube 42, and a tip part 41*b* which is formed more thinly on the tip side from the contact part 41*a* than the contact part 41*a*. The blade member 41 is configured with one metal member, such as nickel alloy. The blade member 41 is normally pressed in a bent state against the plate roll 10, and the blade member 41 is configured such that the tip part 41*b* is formed more thinly than the contact part 41*a* so that the blade member 41 is efficiently deformed at the tip part 41*b* by the tube 42. However, the configuration of the blade member is not limited to the above, and the blade member may be configured such that a reinforcing plate 41*e* is joined to a blade 41*d* as blade member 41*c* of FIG. 3(B). Further, the surface of the blade member 41 may be subjected to a chromium plating process to increase hardness, or the surface may be coated with Teflon (registered trademark) to improve peel property of paint or solvent resistance.

The tube 42 applies pressing force to the blade member 41 when fluid such as air is supplied from the pressure supply unit 53 to be described later. Further, the tube 42 may be provided with a protective film 42*a* such as Teflon (registered trademark) on the surface as shown in FIG. 2(B) so as to improve solvent resistance as in the case of the blade member 41. Further, the protective film 42*a* may be formed by a surface treatment. The upper holder 43 holds the blade member 41 together with the lower holder 44 and is disposed on the upper side of the blade member 41. The upper holder 43 has a tube positioning part 43*a* (corresponding to a positioning part) on the tip end on the plate roll side.

The tube positioning part 43*a* is configured to hold the tube 42 which is expanded and contracted by the pressure supply unit 53 to be described later, and is formed into a V-shape in a side view in the present embodiment, but the shape is not limited thereto. Other than the above, the positioning part 43*a* may have a curved contact surface having a U-shape in a side view. The positioning part 43*a* holds the tube 42, being in contact with the tube 42 from the above. On the lower side of the tube 42 is disposed the blade member 41, and the blade member 41 is held by stiffness of the blade member 41 itself and a tube positioning part 43*a*. Although the blade member 41 is not bent in FIG. 2(A), the blade member 41 is actually bent as shown in FIG. 2(B) and FIG. 2(C). For this reason, as shown in FIG. 2(C), the positioning part 43*a* may be configured to have an opening 43*b* on the opposite side of the side of the blade member 41 on which the blade member 41 is in contact with the plate roll 10 so that the deformation with which the tube 42 is brought into contact is allowed when the blade member 41 is brought into contact with the plate roll 10 and is thus bent. Because the blade member 41 is configured as described above, it is possible to more directly press the part at which the blade member 41 is in contact with the plate roll 10, and the pressing force can be adjusted more accurately.

The lower holder 44 grips and holds a position of the blade member 41 as close as possible to the plate roll 10 with the upper holder 43. The tip end of the contact position between the lower holder 44 and the blade member 41 is configured to be more distant from the plate roll 10 than the contact position between the tube 42 and the blade member 41 is. The lower holder 44 is configured with metal material such as steel and is disposed to extend toward the plate roll 10. The mounting member 45 is connected on the lower holder 44 at the rear end side thereof, with respect to the plate roll 10, with a bolt or the like, but the connection method is not limited to a bolt.

The mounting member 46 installs the mounting member 45 with a bolt or the like. The mounting member 46 is movably connected to the mounting member 47 on the lower side of the mounting member 46 by using a sliding shape such as a groove, and the blade member 41 is configured to be able to move close to and away from the plate roll 10 approximately in a radial direction by this configuration.

The screw 48 slidingly moves the mounting member 46 in a direction in which the mounting member 47 extends (the direction from the upper left to the lower right in the case of FIG. 1), depending on a rotation amount of the screw 48. With this arrangement, the mounting member 45, the upper holder 43, the lower holder 44, the tube 42, and the blade member 41, which are mounted at a part upper than the mounting member 46, move slidingly together with the mounting member 46, in the direction in which the mounting member 47 extends.

The rotary part 49 integrally rotates the structure including the blade member 41 to the screw 48 around a rotation axis of the rotary part 49. The rotary part 49 is configured with a gear, a screw, or the like and has a configuration similar to the conventional configuration; therefore, the description is skipped.

The pressure supply unit 53 is configured with a cylinder and supplies fluid to be fed to the tube 42. Examples of the fluid to be fed to the tube 42 include, but not limited thereto, compressed air, oil, and the like. The pressure adjusting valve 52 is connected to the distributing pipe 51 and adjusts the pressure of the fluid to be supplied to the distributing pipe 51. The distributing pipe 51 is connected to the tube 42 to supply the fluid which expands and contracts the tube 42.

In the present embodiment, as shown in FIG. 4(A), the tube 42 is connected to, but not limited thereto, a single distributing pipe 51. As shown in FIG. 4(B), the tube 42 may be connected to a plurality of distributing pipes 51. The blade member 41, which applies pressing force to the plate roll 10, is a member extending in the sheet surface direction of FIG. 2, and the tube 42 is also arranged along with the blade member 41 in the sheet surface direction of FIG. 2.

As described above, because the tube 42 extends in an elongated shape in the sheet surface direction of FIG. 2, examples of the configuration in which the tube 42 is evenly pressed in the longitudinal direction of the tube 42 include a manner in which the single distributing pipe 51 is connected and a manner in which the distributing pipes 51 are connected to the tube 42, being arranged in the longitudinal direction of the tube 42 at predetermined intervals. This configuration allows the tube 42 to be expanded and contracted evenly in the longitudinal direction of the tube 42, so that the plate roll 10 can be pressed evenly in the longitudinal direction.

The controller 54 is connected to a pressure control valve 52 and the pressure sensor 55, and adjusts the pressure in the tube 42 applied by the pressure control valve 52 on the basis of the pressure in the tube 42 detected from the pressure sensor 55. The pressure sensor 55 detects the pressure of the fluid flowing through the distributing pipe 51, converts the pressure into an electric signal, and transfers the electric signal to the controller 54. The defect detection unit 56 is configured with a camera and the like, shoots an image device coated with ink to perform an image analysis, and transfers the analysis result to the controller 54. The controller 54 adjusts the pressure applied by the pressure control valve 52 on the basis of the analysis result.

Next, a function and effect according to the present embodiment will be described. A blade which controls a thickness of an ink layer applied to a plate roller provided on a printing machine and the like is configured with a thin plate-like member. A slight change in a thin plate-like blade member affects a print quality, and pressing force has to be quite delicately applied by the blade member on the plate roller.

In view of the above, the blade device 40 according to the present embodiment is configured as follows. The upper holder 43 and the lower holder 44 hold the blade member 41, and the pressing force of the blade member 41 is adjusted bye the tube 42 expanding and contracting to adjust the pressure while the tube positioning part 43*a* and the blade member 41 are holding the tube 42, where the tube positioning part 43*a* is formed on the tip end, of the upper holder 43, on the plate roll 10 side. As described above, because the tube 42 can be pressed against the blade member 41 in a state that nothing like the upper holder 43 or the lower holder 44 is located on the tip side from the tube 42, the other members do not easily affect the pressure due to the tube 42, and the pressing force of the blade member 41 can thus be adjusted accurately.

As described above, since the position at which the tube 42 and the blade member 41 contact each other is configured to be closer to the plate roll 10 than the lower holder 44 is, it is possible to reduce the influence of the pressing at the tip end of the blade member 41 due to the lower holder 44, and the pressing force due to the blade member 41 can thus be delicately adjusted.

Further, because a contact surface, of the tube positioning part 43*a*, in contact with the tube 42 is configured to be a recessed part having, for example, a V-shape, it is possible to prevent the tube 42 from unintentionally moving due to fluctuation of the pressure even if there is no member like the lower holder 44 on the opposite side of the tube positioning part 43*a*; thus, it is possible to stably apply pressure to the blade member 41 and to thus cause the blade member 41 to stably apply the pressing force to the plate roll 10. Further, the tube positioning part 43*a* is configured to have the opening 43*b* which, when the blade member 41 comes in contact with the plate roll 10 and gets bent, allows the plate roll 10 to come in contact with one surface of the bent blade member 41 and the tube 42 to come in contact with the other surface. Therefore, it is possible to more directly press the part at which the blade member 41 is in contact with the roller such as the plate roll 10 which is coated with coating material, and it is thus possible to more accurately adjust the pressing force.

Further, the tube 42 is formed in an elongated shape, and the distributing pipe 51 for supplying the fluid to expand and contract the tube 42 is not only disposed in a single member but also arranged in a plurality of pieces at intervals in the longitudinal direction of the tube 42 as shown in FIG. 4(B). Thus, it is possible to evenly apply pressure to the tube 42 in an elongated shape also in the longitudinal direction and to evenly apply pressing force to the plate roll 10.

Further, as shown in FIG. 3, the blade member 41 is formed more thinly at the tip part 41*b* than at the part 41*a*, which contacts with the tube 42. With this arrangement, it is possible to efficiently transfer the pressure due to the tube 42 to the tip end so as to appropriately bend the blade member 41 and to apply pressing force. Further, the tube 42 can be configured to be provided with the protective film 42*a* which provides resistivity against solvent included in ink, or can also be configured to be subjected to a surface treatment instead of being provided with the protective film 42*a*. Such a configuration can delay the deterioration of the tube 42 even if ink is attached to the tube 42.

Further, because the tube positioning part 43*a* is integrally configured as a part of the upper holder 43, the configuration can contribute to cost reduction of the blade device 40 which can raise the print quality.

Further, because the blade device is configured to have the pressure adjusting valve 53 and the pressure sensor 55 as an adjustment unit which adjusts the pressure of the fluid flowing through the tube 42, it is possible to adjust, when necessary, the pressure applied to the blade member 41 so as to adjust the pressing force applied by the blade member 41; therefore, it is possible to keep the print quality high even if there is a change in the base material B or the like on which printing is performed. Further, the blade device 40 according to the first embodiment can be used for the printing machine 100 having the plate roll 10 and the ink pan 30.

Second Embodiment

FIG. 4 is an enlarged view showing the vicinity of a plate roll to which a blade device according to a second embodiment of the present invention is applied. In the first embodiment, the description is given on an embodiment of the blade device in which ink is stored below the plate roll of the intaglio plate roll in the so-called gravure printing, but the configuration is not limited thereto.

Figure 5:
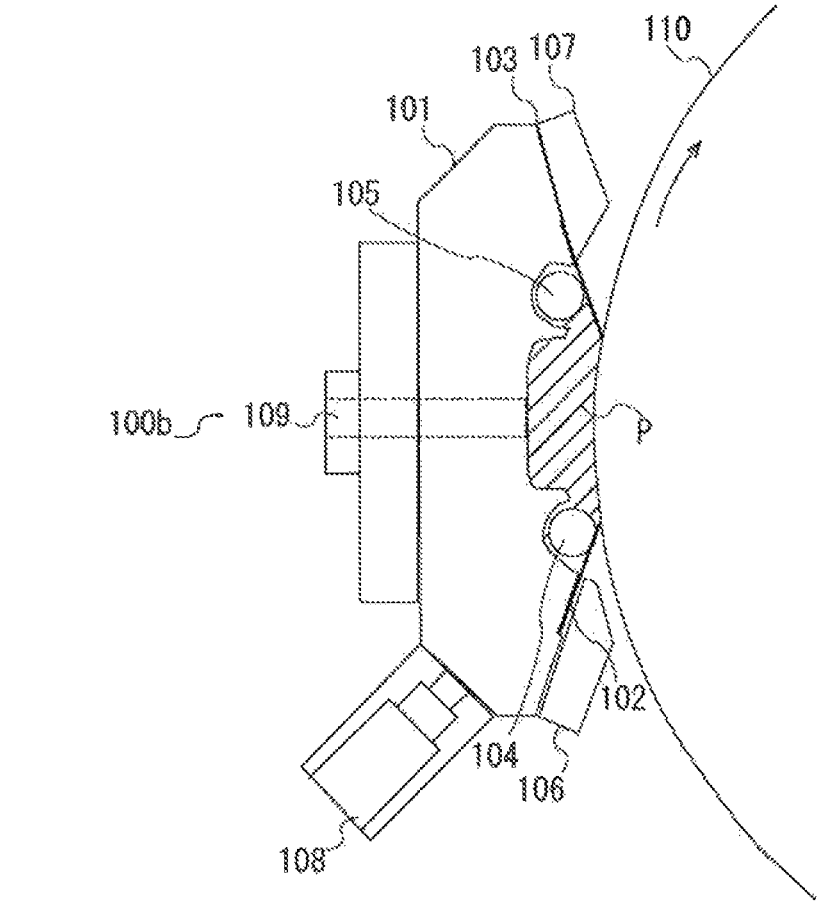
FIG. 5 is an enlarged view showing the vicinity of a plate roll of a printing machine to which the blade device is applied in a second embodiment.

FIG. 5 is an enlarged view of the vicinity of the plate roll to which the blade device is applied in the second embodiment of the present invention. A printing machine 100*a* in the second embodiment has a plate roll 110 and a blade device 100*b*. The blade device 100*b* has a chamber 101, blade members 102 and 103, tubes 104 and 105, holders 106 and 107, an ink supply unit 108, and an ink discharge part 109. Because the other components of the printing machine in the present embodiment are similar to the conventional components, the description of those components is skipped.

The ink supply unit 108 is a component to supply ink to be supplied to the chamber 101, and examples of the ink supply unit 108 include, but not limited thereto, an injection type feeder having a nozzle shape, for example. The chamber 101 forms together with the blade members 102 and 103 a sectioned space P (see the hatched part in FIG. 5) in which the ink supplied from the ink supply unit 108 is stored. Because the space P for storing ink can be configured with the chamber 101, the printing machine according to the present embodiment does not have to be provided with the ink pan 30 as in the first embodiment. Therefore, the place for supplying ink can be made small.

The blade member 102 is attached on the lower part of the chamber 101 and prevents the ink supplied from the ink supply unit 108 from dropping downward. The tube 104 is disposed between the blade member 102 and the chamber 101 and expands and contracts to apply pressure to the blade member 102. The holder 106 grips the blade member 102 with the chamber 101. In a similar manner to that of the lower holder 44 of the first embodiment, the end part, of the holder 106, close to the plate roll 110 is located more separately from the plate roll 110 than the contact position between the tube 104 and the blade member 102 is.

The blade member 103 is disposed at the upper part of the chamber 101 and is pinched by the holder 107 and the chamber 101. The tube 105 is disposed between the chamber 101 and the blade member 103, and expands and contracts to apply pressure to the blade member 103. The holder 107 pinches the blade member 103 with the chamber 101. The holder 107 is configured in a manner similar to that of the holder 106, and its tip end on the plate roll 110 side is located more separately than the contact position between the tube 105 and the blade member 103 is.

The ink discharge part 109 is provided approximately at the center of the chamber 101 in order to discharge to the outside an excessive part of the ink stored by the chamber 101 and the blade members 102 and 10. The ink discharge part 109 is configured with an opening, and if the ink stored by the chamber 101 reaches a certain height, the ink flows out to the ink discharge part 109, so that the stored ink does not exceed a certain height. Because the plate roll 110 is similar to the intaglio plate roll 10 of the first embodiment, the description of the plate roll 110 is skipped. Note that the printing machine according to the present embodiment is not only used for a gravure printing machine (intaglio plate printing machine) as in the first embodiment but also applied to a flexographic printing machine (relief printing machine) in which the roll 110 configured as a so-called anilox roll which is used for transfer to a printing plate roll. Further, a device which is equipped with the chamber 101 and the blade member 103 as in the present embodiment is also referred to as a doctor chamber.

In the second embodiment, the structure of a doctor chamber is employed, and the thickness of the ink attached to the plate roll 110 is regulated by the blade member 103 while ink is being stored in the space P sectioned by the chamber 101 and the blade member 102. In a manner similar to that of the lower holder 44 of the first embodiment, the tip end, of holder 107, on the plate roll 110 side is not located closer to the plate roll 110 than the contact position between the tube 105 and the blade member 103 is. Therefore, the pressure due to the tube 105 can press the tip end of the blade member 103 against the plate roll 110 almost without being affected by the other components. Thus, an ink reservoir for storing ink can be formed efficiently in terms of space without using the ink pan 30 differently froth the first embodiment, it is possible to accurately adjust the pressing force of the blade member 103 and to thus improve the print quality. As described above, the printing machine 100*a* according to the second embodiment can be used as a gravure printing machine or a flexographic printing machine.

Third Embodiment

Figure 6:
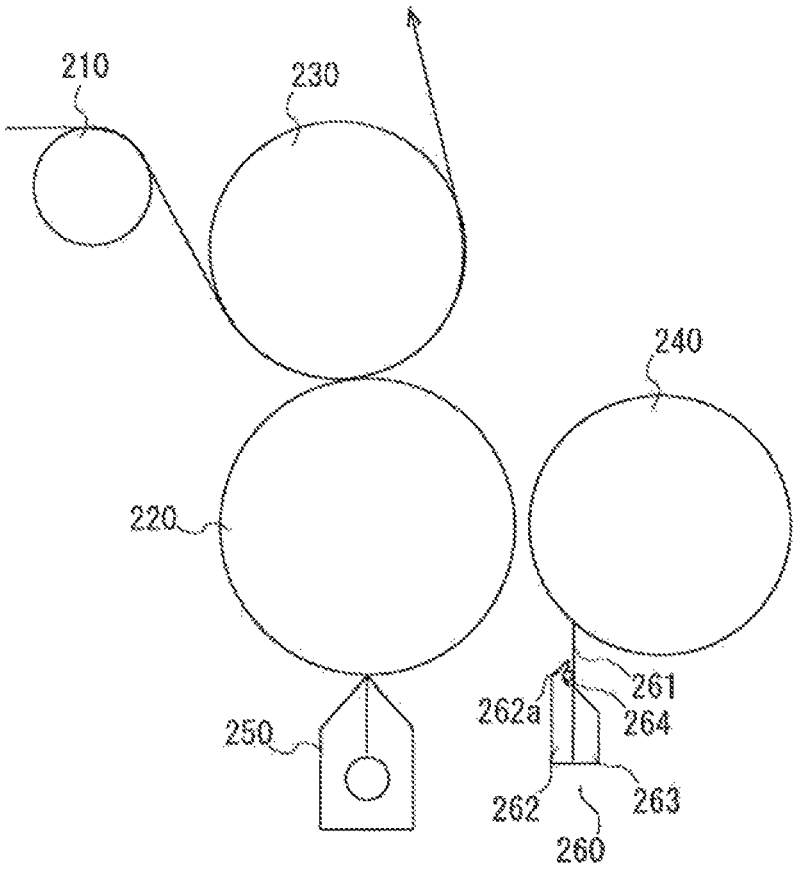
FIG. 6 is a schematic explanatory diagram showing a coating device to which a blade device according to the present invention is applied in a third embodiment.

FIG. 6 is a schematic explanatory diagram showing a coating device to which a blade device according to a third embodiment of the present invention is applied. In the first and second embodiments, the descriptions are made on the aspects in which the blade device is applied to a gravure printing machine using an intaglio plate roll or a flexographic printing machine using a relief plate, but the present invention is not limited to these embodiments.

FIG. 6 is a schematic diagram illustrating a so-called reverse roll coater in which a coating roll for applying ink is rotating in the direction reverse to the conveyance direction of a base material. A reverse roll coater (coating device) 200 of FIG. 6 is equipped with a holding roll 210, a coating roll 220, a backup roll 230, a metering roll 240 (also referred to as a regulation roll or an adjustment roll), an application device 250, and a blade device 260. The reverse roll coater is used for base materials whose thicknesses are not relatively accurate.

The holding roll 210 puts the base material B in a state that the base material B is having tensile force, and the base material B is supplied from a supply roll (not shown) located on the left side from FIG. 6. The coating roll 220 rotates in the rotational direction reverse to the conveyance direction of the base material B. The application device 250 is disposed on the c opposite side in the circumferential direction with respect to the position at which the coating roll 220 is substantially in contact with a backup roll 260 and supplies ink to the coating roll 220.

The backup roll 230 is disposed on the opposite side in the direction in which the coating roll 220 comes in contact with the base material B so that the base material B does not become slack when ink is applied to the base material B by the coating roll 220. As shown in FIG. 6, the metering roll 240 is disposed on the upstream side, in the rotational direction, from the position at which the coating roll 220 is in contact with the backup roll 230, and is disposed in the vicinity of the downstream from the application device 250.

The metering roll 240 forms together with the coating roll 220 an ink reservoir so that the ink supplied from the application device 250 does not drop off the coating roll 220. The metering roll 240 is disposed on the upstream side, on the coating roll 220, from the contact position at which the coating roll 220 is in contact with the base material B so as to regulate or adjust the thickness of the paint applied to the coating roll 220. The blade device 260 configured to be disposed on the downstream side, in the rotational direction on the metering roll 240, from the position at which the metering roll 240 forms together with the coating roll 220 the liquid reservoir, and the blade device 260 scrapes off ink remaining on the surface of the metering roll 240 after supplying ink to the coating roll 220.

In a rough description, the blade device 260 has a blade member 261, holders 262 and 263, and a tube 264. Because the blade member 261 is similar to the blade member 41 of the first embodiment, the description thereof is skipped. Also, the holders 262 and 263 have configurations similar to those of the upper holder 42 and the lower holder 43 of the first embodiment, and on the tip end of the holder 262 is provided with a tube positioning part 262*a* for holding the tube 264. As with the above embodiments, the tip end of the holder 263 is configured to be more distant from the metering roll 240 than the contact position between the tube 264 and the blade member 241 is.

As described above, with the blade device 260 for the reverse roll coater, the ink reservoir is formed, and the ink attached to the metering roll 240 after applying ink to the coating roll 220 is accurately scraped off, whereby it is possible to prevent the print quality being lowering due to ink remaining at the time of applying next ink. The coating device according to the third embodiment can be used for the coating device 200 in which the contact position between the coating roll and the base material overlaps as shown in FIG. 6.

The present invention is not limited to the above embodiments, and various modifications can be made within the scope of the claims.

Modified Example of Third Embodiment

Figure 7:
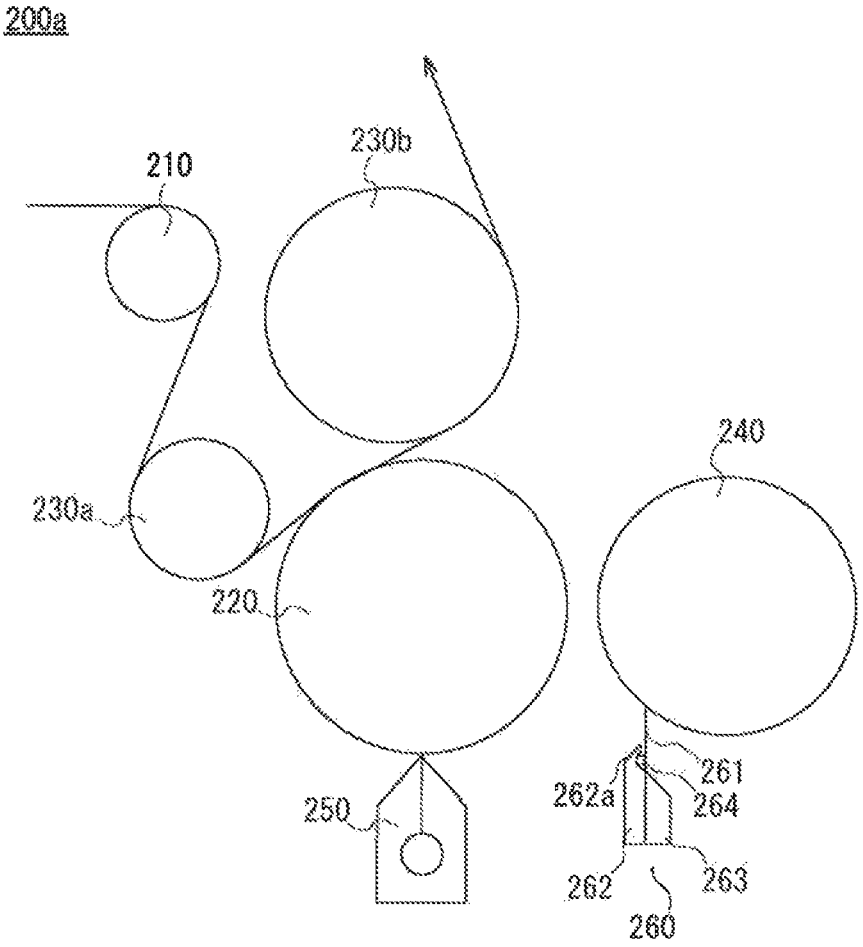
FIG. 7 is a schematic explanatory diagram showing a modified example of FIG. 6.

The reverse roll coater of the third embodiment is not limited to the above and can also be configured as follows. FIG. 7 is a schematic explanatory diagram illustrating a modified example of the third embodiment of the present invention. A description will be given on a coating device 200*a* of FIG. 7, which is a kiss reverse roll and in which a roller is disposed on the side opposite to the coating roll 220 with the base material B therebetween, where the roller is located distant, from the contact position between the coating roll 220 and the base material, in the direction in which the base material B extends.

The coating device 200*a* according to a modified example of the third embodiment has a holding roll 210, a coating roll 220, backup rolls 230*a* and 230*b*, a metering roll 240, an application device 250, and a blade device 260. The coating device 200*a* is used in a case of applying ink such as resin which should be applied with a low printing pressure. The same reference signs are assigned to the components similar to those in FIG. 6 and the explanation of the above components are skipped. Because the backup rolls 230*a* and 230*b* are different only in the arrangement, and a detailed description is skipped.

The blade device 260 can be applied not only to the coating device 200 shown in FIG. 6 in which the contact position between the backup roll 230 and the base material B substantially coincides with the contact position between the coating roll 220 and the base material B but also to the coating device 200*a* as shown in FIG. 7 in which the contact positions between the backup rolls 230*a* and 230*b* and the base material B are away from the contact position between the coating roll 220 and the base material B. Therefore, also in the kiss reverse roll coater, the ink attached to the metering blade 240 after ink is applied to the ink reservoir is accurately scraped off, and the print quality can thus be made good.

REFERENCE SIGNS LIST

10, 110 Plate roll
100, 100*a* Printing machine
101 Chamber
20 Press roll
200, 200*a* Roll coater (coating device)
210 Holding roll
220 Coating roll
230, 230*a*, 230*b* Backup roll
240 Metering roll (regulation roll, adjustment roll)
250 Application device
30 Ink pan
40, 100*b*, 260 Blade device
41, 41*c*, 102, 103 Blade member
41*a* Contact part
41*b* Tip part
41*d* Blade
41*e* Reinforcing plate
42, 104, 105 Tube
43 Upper holder (first holding part)
43*a*, 262*a* Tube positioning part (positioning part)
44 Lower holder (second holding part)
45, 46, 47 The mounting member
48 Screw
49 Rotary part
51 Distributing pipe
52 Pressure adjusting valve
53 Pressure supply unit
54 Controller
55 Pressure sensor
56 Defect detection unit

The invention claimed is:

1. A blade device comprising:

a blade member contacting with a roller to which coating material is to be applied;

a first holding part contacting with the blade member from one surface side of the blade member;

a second holding part contacting with the blade member from another surface side of the blade member;

a deformation member contacting with the blade member and enabling to expand and contract by pressure of fluid; and a positioning part which is provided on the first holding part and positions the deformation member closer to the roller, in a direction in which the blade member extends, than a tip end of the second holding part, wherein the positioning part has a V-shaped contact surface which is in contact with the deformation member, wherein the deformation member adjusts pressing force, of the tip end of the blade member, against the roller by being expanded or contracted while being held by the positioning part and the blade member.

2. The blade device according to claim 1, wherein the positioning part has a concave portion which is in contact with a side surface of the deformation member.

3. The blade device according to claim 1, wherein the positioning part has an opening which, when the blade member comes in contact with the roller and is bent, allows the roller to come in contact with one surface of the bent blade member and allows the deformation member to come in contact with another surface of the bent blade member.

4. The blade device according to claim 1, wherein the deformation member is configured in an elongated shape, the blade device comprises a plurality of supplying members arranged at intervals in a longitudinal direction of the deformation member, and the supplying members are configured to supply fluid which expands and contracts the deformation member.

5. The blade device according to claim 1, wherein the blade member is formed more thinly on a tip side from a contact part at which the blade member is in contact with the deformation member than the contact part.

6. The blade device according to claim 1, wherein the coating material includes solvent as an ingredient, and the deformation member is provided with a protective film which provides resistivity against the solvent in the coating material, or the deformation member has been subjected to a surface treatment which provides resistivity against the solvent in the coating material.

7. The blade device according to claim 1, wherein the positioning part is configured integrally with the first holding part.

8. The blade device according to claim 1, further comprising an adjustment unit which adjusts pressure due to the fluid.

9. The blade device according to claim 8, wherein the adjustment unit comprises:

a pressure sensor which converts pressure inside the deformation member into an electric signal, and a pressure adjusting valve which is connected to the pressure sensor and adjusts pressure to be applied to the deformation member, based on the electric signal from the pressure sensor.

10. A printing machine comprising:

a plate roll which prints a print on a base material;

a blade device according to claim 1, wherein the blade device regulates a thickness of coating material which is applied to the plate roll; and a reservoir unit which is disposed under the plate roll and stores the coating material to be supplied to the plate roll.

11. A printing machine comprising:

a plate roll which prints a print on a base material; and a blade device according to claim 1, wherein the first holding part is configured also as a doctor chamber which stores ink to be supplied to the plate roll.

12. A coating device comprising:

a coating roll which applies the coating material;

a backup roll which is disposed on a side opposite to the coating roll with a base material pinched therebetween and provides force which counters pressing force from the coating roll; and a regulation roll which is disposed on an upstream side, on the coating roll, from a contact position between the coating roll and the base material and which regulates a thickness of paint applied to the coating roll, wherein the blade device according to claim 1 is used to scrape off the paint attached to the regulation roll on a downstream from a position at which the thickness of the paint applied to the coating roll is regulated on the regulation roll.

13. The coating device according to claim 12, wherein the backup roll is disposed so that a contact position between the coating roll and the base material overlaps.

14. The coating device according to claim 12, wherein the backup roll is disposed so that a contact position between the backup roll and the base material is disposed away from the contact position between the coating roll and the base material.

* * * * *